US008186014B2

(12) United States Patent
Pecar et al.

(10) Patent No.: US 8,186,014 B2
(45) Date of Patent: May 29, 2012

(54) FURNITURE HINGE WITH EQUIPMENT

(75) Inventors: David Pecar, Pobegi (SI); Franc Banko, Koper (SI); Valter Svara, Izola (SI); Klavdij Metlika, Pobegi (SI); Gordon Rush, Lemgo (DE)

(73) Assignee: LAMA d.d. Dekani, Dekani (SI)

( * ) Notice: Subject to any disclaimer, the term of this patent is extended or adjusted under 35 U.S.C. 154(b) by 883 days.

(21) Appl. No.: 11/884,541

(22) PCT Filed: Feb. 14, 2006

(86) PCT No.: PCT/SI2006/000002

§ 371 (c)(1),
(2), (4) Date: May 30, 2008

(87) PCT Pub. No.: WO2006/088435

PCT Pub. Date: Aug. 24, 2006

(65) Prior Publication Data

US 2009/0119876 A1 May 14, 2009

(30) Foreign Application Priority Data

Feb. 18, 2005 (SI) ..... 200500042
Jul. 1, 2005 (SI) ..... 200500195

(51) Int. Cl.
*E05F 1/08* (2006.01)

(52) U.S. Cl. ..... 16/286; 16/374

(58) Field of Classification Search ..... 16/286–289, 16/294, 54, 56, 366, 370–371, 354
See application file for complete search history.

(56) References Cited

U.S. PATENT DOCUMENTS

| | | | | |
|---|---|---|---|---|
| 2,078,815 | A * | 4/1937 | Segar | 16/286 |
| 2,940,116 | A * | 6/1960 | Salice | 16/291 |
| 3,362,042 | A * | 1/1968 | Salice | 16/278 |
| 5,012,551 | A | 5/1991 | Beneke et al. | 16/49 |
| 5,269,043 | A * | 12/1993 | Yang | 16/68 |
| 6,591,454 | B2 * | 7/2003 | Brustle | 16/374 |
| 6,859,979 | B2 * | 3/2005 | Egger et al. | 16/327 |
| 7,065,833 | B2 * | 6/2006 | Kropf | 16/286 |
| 7,194,785 | B2 * | 3/2007 | Li | 16/85 |
| 7,395,580 | B2 * | 7/2008 | Brustle et al. | 16/50 |
| 7,562,416 | B2 * | 7/2009 | Lautenschlager et al. | 16/286 |
| 2002/0010977 | A1 | 1/2002 | Salice | 16/49 |
| 2003/0200625 | A1 * | 10/2003 | Zimmer | 16/306 |
| 2004/0093693 | A1 | 5/2004 | Salice | 16/354 |
| 2004/0205935 | A1 | 10/2004 | Lautenschläeger et al. | 16/374 |
| 2005/0246863 | A1 * | 11/2005 | Chesworth et al. | 16/221 |

FOREIGN PATENT DOCUMENTS

| | | |
|---|---|---|
| DE | 20104100 | 5/2001 |
| DE | 202004011636 | 9/2004 |
| EP | 0926382 | 6/1999 |
| GB | 2178791 | 2/1987 |
| WO | 2004020771 | 3/2004 |
| WO | 2004083580 | 9/2004 |
| WO | 2004092516 | 10/2004 |
| WO | 2005095742 | 10/2005 |

* cited by examiner

*Primary Examiner* — Chuck Y. Mah
(74) *Attorney, Agent, or Firm* — Jacobson Holman PLLC

(57) ABSTRACT

A furniture hinge with equipment includes a toggle-type hinge and a shock absorber. The latter is either a rotary (a first approach) or a line (a second approach) shock absorber. Irrespective of the approach, the shock absorber is arranged transversely to a major longitudinal axis of the toggle-type hinge and bound to a hinge pot.

15 Claims, 8 Drawing Sheets

FURNITURE HINGE WITH EQUIPMENT

This is a National phase of PCT/SI2006/000002 filed Feb. 14, 2006, and published in Slovenian.

FIELD OF THE INVENTION

The present invention relates to a furniture hinge with equipment comprising a toggle-type hinge and a shock absorber.

BACKGROUND OF THE INVENTION

With a furniture unit provided with toggle-type hinges, possible shocks of door wings generated by buckling can prove to be dangerous (e.g. due to glass wings getting shattered) or at least inconvenient. There exist techniques of absorbing shocks by the distal end of a door wing and techniques of absorbing shocks by a hinge. The present invention relates to the latter approach, which, in the development of hinges, resulted in a union and co-operation of a toggle-type hinge and a line shock absorber and thus resulted in a furniture hinge with equipment.

From US 2004/0205935 A1 (to Lautenschläger et al.) there is known a reciprocating, line-type, damping device mounted onto a hinge arm for two members of furniture unit interconnected by a toggle-type hinge, which members of furniture unit swing relatively to each other. From WO 2004/092516 A1 (Brüstle et al.) there is known a hinge with a reciprocating, line-type, damping device mounted to a pot member of said hinge. In both cases, the respective shock absorber resides in a plane of a major axis of the hinge.

As expected, it is, in a practically standardized furniture hinge, a result of integration of a line damping device of this kind in a plane of a major axis of said hinge that there certainly occur assembling and servicing problems in addition to aesthetic and room-occupying disadvantages. Namely, with respect to a furniture unit, all hinges of this kind are adjusted by a hinge arm in x-, y- and z-axes, whereas a line damping device mounted to a hinge in the plane of a major axis of the hinge prevents, with known furniture hinges with equipment, respective approaches to said hinge arm.

SUMMARY OF THE INVENTION

It is thus an object of the present invention to obviate the said disadvantage.

Two approaches of solving the problem as set forth above are foreseen according to the present invention. A first approach provides a rotary shock absorber arranged transversely to a major axis of a toggle-type hinge, and a second approach provides a line shock absorber arranged transversely to a major axis of a toggle-type hinge, whereat the major axis of the toggle-type hinge is coincident with a major longitudinal axis of a hinge arm, and rectangular to a turning axis of a furniture door. The open space along the major axis of the hinge over the hinge arm of the furniture hinge remains substantially intact with both said inventive approaches.

With both approaches, it is important for the invention that a swingable wing of a shock absorber arranged on a hinge pot co-operates with a hinge arm of a toggle-type hinge. The details of embodiments of such two inventive approaches then relate to the problem of transferring the swinging motion of the wing to said shock absorber as well as to the problem of fastening said shock absorber onto said hinge pot.

According to the present invention with an embodiment comprising a rotary shock absorber, said wing is mounted onto a rotary housing of said rotary shock absorber by being fitted into it or formed integrally with it and it swings together with it, while with an embodiment comprising a line shock absorber, said wing is mounted onto a rotary housing of said rotary shock absorber by being fitted into it and it only swings while said housing of said shock absorber is merely axially shifted.

Irrespective of said approaches, the shock absorber is connected to said hinge pot of said toggle-type hinge indirectly by means of a holder of shock absorber. Said holder comprises:

a first bearing to receive,
- with said first approach: a stationary part of said shock absorber, and
- with said second approach: an axially shiftable housing of shock absorber, a second bearing arranged coaxially with the first one to receive,
- with said first approach: a rotary part of said shock absorber, and
- with said second approach: a stationary, i.e. fixed part of said shock absorber, an apertured disc (a leg of said holder) integral with each of said bearings, and a spacer piece to constitute a unique holder with two pairs of elements, composed each of bearing and an apertured disc.

With a basic embodiment of said holder of shock absorber, said holder is adapted to a hinge pot of said toggle-type hinge in order to superpose said apertured discs on a flange of said hinge pot, with fastening holes of said holder coinciding with fastening holes in said flange of hinge pot and, preferably, the said spacer piece abutting against a distal transverse edge of said hinge pot.

With said first approach, a torsion spiral spring is inserted into a cavity of the second of said two bearings, with one arm of said spring retained by said rotary housing of shock absorber and the other one by said bearing of holder. If installing a rotary shock absorber having a return spring integrated, said torsion spiral spring is not required.

With said second approach, a ring coulisse is integrated into said axially shiftable housing of said line shock absorber. Axially in front of said ring coulisse, a counter-coulisse is formed integrally with a wing, said wing put on said housing of shock absorber, with said counter-coulisse permanently engaging said coulisse. Formed integrally with the rear side of said wing is an arcuate rib, which engages a respective slot provided in said spacer piece of said holder. Thus, said wing is located, as to its position, in the axial direction of the shock absorber.

With an altered holder of shock absorber, a hinge pot adapted to said holder retains the latter by means of a snap connection, said holder snapping the hinge pot from below. To this end, one or more, preferably two saddle-shaped recesses are foreseen along a distal transversal edge of a fastening flange of a hinge pot, while two prongs for engaging from below are formed integrally with said spacer piece, said prongs provided with respective indentations for engaging said recesses.

With a still further altered embodiment of a holder, a saddle-shaped recess is foreseen with each of two longitudinally extending reinforcing projections of a fastening flange of a hinge pot, with said holder providing a prong for engaging one of said recesses from below, while a drum-shaped appendix is integrally added to said holder for operating another one of two said recesses, said appendix retaining a plug, which provides, formed integrally with it, a latch member for engaging said another saddle-shaped recess.

In a still further embodiment according to the present invention, a line shock absorber arranged transversely to a major axis of the toggle-type hinge comprises a housing, a piston rod, and an outer pressure spring or an inner pressure spring. A bearing of a wing sleeve is fitted into the mantle configuration of the housing of the shock absorber. A sleeve and a wing represent the main constructional components of said wing sleeve. Both ends of the sleeve are plainly cut to size, with a wedged recess provided frontally at the end of the sleeve not reached by the shock absorber. To a base portion of a striking rolling side of the wing, one end of a special spiral rib is connected or resides there, said rib being placed on the mantle surface of the sleeve.

An assembly composed of a shock absorber and a wing sleeve is inserted into a holder of the shock absorber.

The section of said holder to accommodate the assembly of the shock absorber and the wing sleeve is composed of a semi-bearing, a bearing and a spacer piece, with said members all fitted into the mantle diameter of the wing sleeve. Said spacer piece practically provides for a 120° bearing for said wing sleeve with a first edge of said bearing residing at a base portion of the holder and a second edge thereof residing in the horizontal diametral level of the semi-bearing. In the said practically 120° bearing a spiral groove is foreseen to accommodate and guide said spiral rib.

A semi-bearing having two functions, namely to be a thrust bearing and a cap, respectively, is provided with one end of the holder of the shock absorber, while an axial control support is provided with the other end of said assembly.

The section of the holder prepared to be fastened to a hinge pot of a toggle-type hinge provides a flange having snap projections to engage recesses provided in a flange of the hinge pot, said recesses arranged outside within a zone of a cavity made to incorporate said hinge pot in the furniture panel. Alternatively, the section of the holder prepared to be fastened to a hinge pot of a toggle-type hinge provides a flange having snap projections to engage openings provided in a wall portion of a cavity of said hinge pot in a direction from inside to outside. In the latter embodiment, two prongs for engaging from below are foreseen with the spacer piece, and bearings are foreseen to receive them in a reinforcing rim of the hinge pot.

Hereinafter, the present invention is disclosed in more detail on the basis of embodiments of:

- a new use of a rotary shock absorber known per se,
- a new incorporation of a line shock absorber known per se into a toggle-type furniture hinge also known per se, and
- a new combination of said toggle-type hinge and said rotary and line shock absorbers, respectively, said combination concerning the above two objects.

The said three objects of the present invention (use, incorporation, combination) are so linked as to form a single general inventive concept.

BRIEF DESCRIPTION OF THE DRAWINGS

In the enclosed drawings, there show.

DETAILED DESCRIPTION OF THE PREFERRED EMBODIMENTS

A rotary shock absorber known from e.g. EP 0 926 382 (Wonn), a toggle-type furniture hinge known from e.g. GB 2 178 791 A (Ferrari), and a line furniture shock absorber known from e.g. US 2002/0010977 A1 are considered relevant for an implementation of the present invention.

From EP 0 926 382, a "use" of a rotary shock absorber is also known, however, said shock absorber is used to be a hinge not functioning as a toggle-type hinge (similar to that of furniture).

Thus, a fundamental substantive feature of the present invention relates to a novel "use" of a "rotary" shock absorber known per se, in this specific case it relates to a use of a rotary shock absorber substantially as disclosed in EP 0 926 382 with a toggle-type furniture hinge substantially as disclosed in GB 2 178 791 A, and to a new "incorporation" of a line furniture shock absorber substantially as disclosed in US 2002/0010977 A1.

Figure 1:
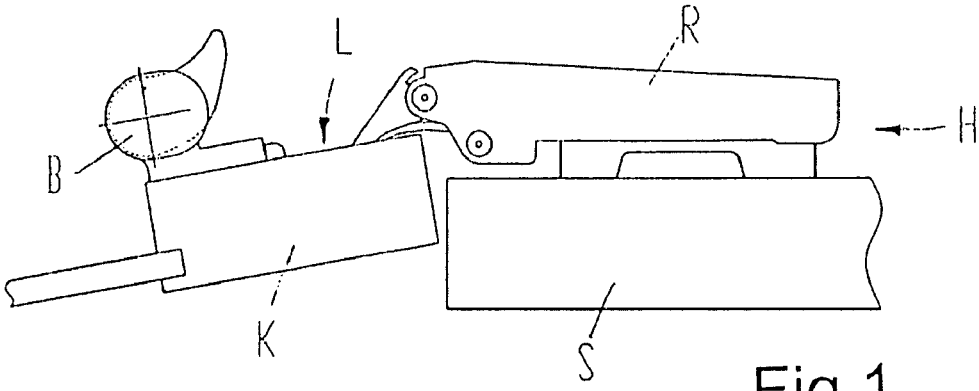
FIG. 1 an elevational view of a fragment of a side panel of a furniture unit supporting a hinge arm of a toggle-type hinge, and a fragment of a wing of said furniture unit supporting both a hinge pot of said toggle-type hinge and an inventive shock absorber connected thereto, in an open state, FIG. 2 the members of FIG. 1 in a position of said shock absorber striking, in the course of closing the furniture unit, against said hinge arm, FIG. 3 the members of FIGS. 1-2 in a position of the operation of closing the furniture unit finished, the furniture being closed and the function of the shock absorber co-operating with the hinge arm completed, FIG. 4 a three-dimensional illustration of a rotary shock absorber, FIG. 5 an exploded view of a hinge pot of a toggle-type hinge, a holder (FIG. 17) to be connected thereto, of the rotary shock absorber, the rotary shock absorber (FIG. 4) connected to said holder of the rotary shock absorber, and functional fittings belonging to them, FIG. 6 an elevational view of a line shock absorber having a piston rod extended (a prior-to-shock situation), FIG. 7 similar to FIG. 6 with the line shock absorber having the piston rod encased (an after-shock situation), FIG. 8 a three-dimensional illustration of an assembly composed of a holder of a line shock absorber, the line shock absorber (FIG. 6) (its axle support for the piston rod of line shock absorber shown dismounted), and a wing of the shock absorber, FIG. 9 similar to FIG. 8 with the shock absorber in an after-shock position (its axle support for the piston rod of line shock absorber shown mounted), FIG. 10 a worm's eye-view of an assembly composed of the shock absorber and a modified holder belonging to it, FIG. 11 a worm's eye-view of the assembly of FIG. 10 bound to a hinge pot of a toggle-type furniture hinge, FIG. 12 similar to FIG. 10 with a holder of the shock absorber altered, FIG. 13 a three-dimensional illustration of a pivot pin having a latch for interconnecting the assembly of FIG. 12 and an adapted hinge pot, FIG. 14 an exploded view of the assembly of FIG. 12, the pivot pin of FIG. 13 residing there, and a hinge pot of a toggle-type furniture hinge, FIG. 15 a three-dimensional worm's eye-view of the assembly of FIG. 14 in assembled state, FIG. 16 separately the hinge pot of the toggle-type furniture hinge of FIG. 15, FIG. 17 a holder of a rotary shock absorber, FIG. 18 an elevational view of the lower side of the assembly of FIG. 11, FIG. 19 an elevational view of a section taken along line XIX-XIX in FIG. 18, FIG. 20 an elevational view of detail XX of FIG. 19, FIG. 21 a three-dimensional illustration of a line shock absorber with an outer pressure spring and a piston rod extended (a prior-to-shock situation), FIG. 22 similar to FIG. 21 with the line shock absorber having an inner spring arrangement, FIG. 23 an exploded view of the shock absorber of FIG. 21 and a wing sleeve belonging to it, FIG. 24 the two members of FIG. 23 in assembled state, FIG. 25 a worm's eye-view of the assembly of FIG. 24, FIG. 26 a three-dimensional illustration of a holder for the assembly of FIGS. 24-25, FIG. 27 an exploded view of the holder of FIG. 26 and the assembly of FIG. 24 in assembled state, a semi-bearing having two functions, namely to be a thrust bearing and a cap, respectively, and an axial control support, all in an operating state prior to the activation of the shock absorber, FIG. 28 the assembly of FIG. 27 in an operating state after a shock being absorbed, FIG. 29 an exploded view of assembly of FIG. 28 with a holder of a line shock absorber altered, in an operating state prior to the activation of the shock absorber, and a hinge pot of toggle-type hinge adapted to it, FIG. 30 similar to FIG. 29, but with an altered interconnection of a shock absorber and a hinge pot of toggle-type hinge adapted to it, FIG. 31 an elevational view of the lower side of assembly of FIG. 30, FIG. 32 an elevational view of a section taken along line XXXII-XXXII in FIG. 31, and FIG. 33 an elevational view of the detail XXXIII in FIG. 32.
Figure 2:
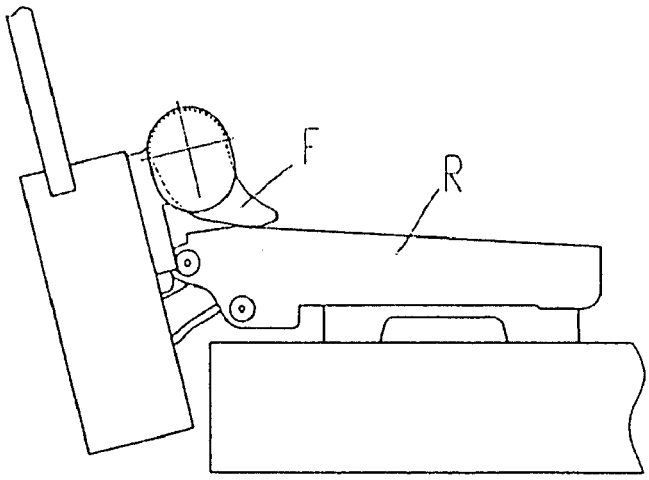
Figure 3:
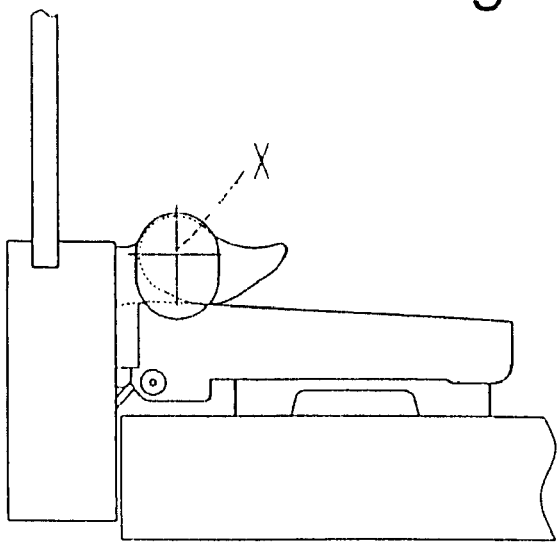

FIGS. 1-3 illustrate a detail of an assembly composed of a furniture side panel S supporting a hinge arm R of a toggle-type hinge H, and a furniture wing K (in this specific case, an embodiment thereof comprising a sheet of glass) supporting a hinge pot of said toggle-type hinge H as well as a shock absorber B bound thereto. With the state of FIG. 1, the shock absorber B is in a stand-by position, next with the state of FIG. 2, when closing the furniture unit, said shock absorber B just struck against said hinge arm R, and finally with the state of FIG. 3, the operation step of closing the furniture unit is finished, the furniture unit is closed and the shock absorber B has fulfilled its damping function. During the sliding of a wing F of said shock absorber B across the top surface of said hinge arm R, it is also swung around its axis of rotation X running perpendicular to a major axis of the toggle-type hinge. The said rotation extends to an angle of about 90°.

Figure 4:
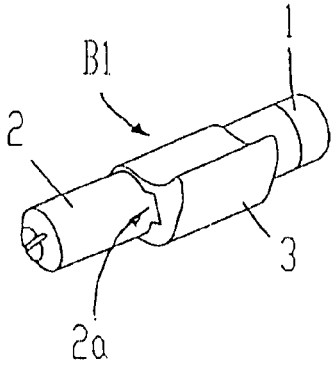

To comply with the intention of the present invention, a rotary shock absorber B1 is prepared as evident from FIG. 4. To this end, a rotary housing 2 of the shock absorber B1 that co-operates with a stationary member 1 of the shock absorber B1 is provided, in this specific embodiment, with an adjusting spring or a round-ended sunk key 2*a*, and a wing 3 fitted into both the housing 2 and the adjusting spring or round-ended sunk key 2*a* is put on both said housing 2 and the adjusting spring or round-ended sunk key 2*a*.

Said rotary housing 2 and the adjusting spring or round-ended sunk key 2*a* of the shock absorber B1 can also be embodied to constitute a unique member.

Figure 17:
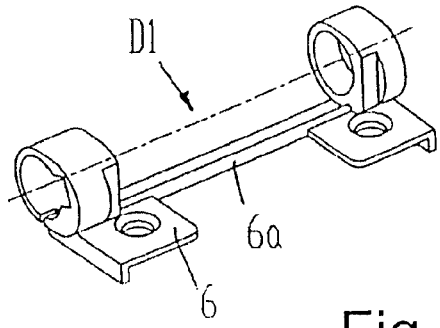
Figure 5:
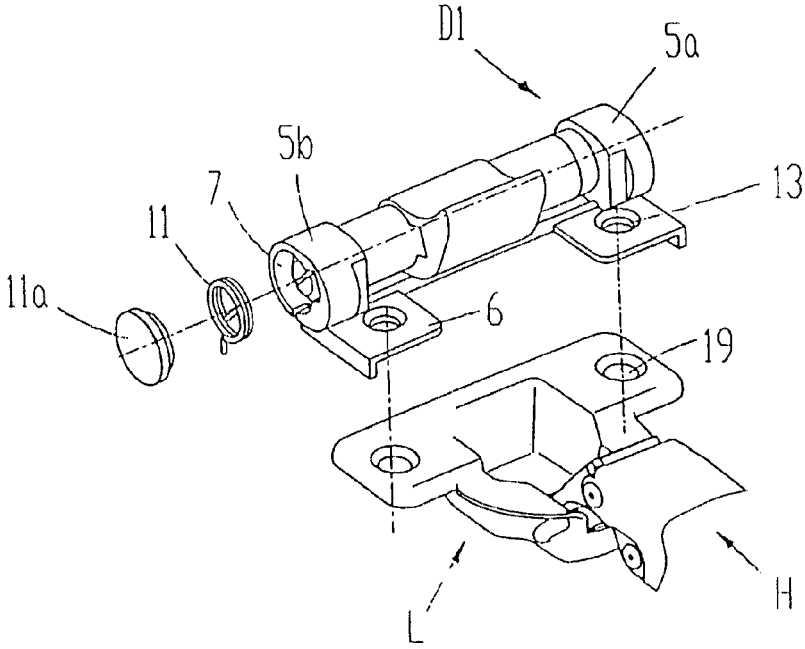

From FIG. 5 there is evident an assembly composed of a hinge pot L of the toggle-type hinge H and of an inventive holder D1 (FIG. 17) of the rotary shock absorber B1, with said holder D1 connected to the hinge pot L, the rotary shock absorber B1 of FIG. 4 connected to said holder D1, and functional fittings belonging to them. The holder D1 comprises a bearing 5*a* to accommodate the stationary member 1 of the shock absorber B1, a further bearing 5*b* coaxial with the former adapted to conduct the adjusting spring or round-ended sunk key 2*a* when assembling, with said bearing 5*a* supporting, in the assembled state, the rotary housing 2 of the shock absorber B1, an apertured (aperture 13) disc 6 added to each bearing 5*a*, 5*b*, and a spacer piece 6*a*, by means of which two pairs of elements composed each of a bearing and an apertured disc constitute a unique holder D1. In this specific case, the holder D1 is fitted into the hinge pot L of the toggle-type hinge H in order to place the bearings 6 superposing a flange of the hinge pot L, with the fastening apertures 13 of the holder D1 coinciding with the fastening holes 19 provided in the flange of the hinge pot L and the spacer piece 6*a* of the holder D1 abutting against a distal transverse edge of the hinge pot L. As to the functional fittings mentioned above, there are a torsion spiral spring 11 as a return spring inserted into a cavity of the bearing 5*b* with one arm of the spring being retained by the rotary housing 2 of shock absorber B1 and the other one by the bearing 5*b* of the holder D1, and a protective cap 11*a*. When swinging the wing 3 between the two positions illustrated in FIGS. 2-3, the spring 11 as such biased is tightened, i.e. wound on, and in the contrary direction it is released, i.e. wound off, whereby the wing 3 is returned into the starting position according to FIG. 5.

Figure 6:
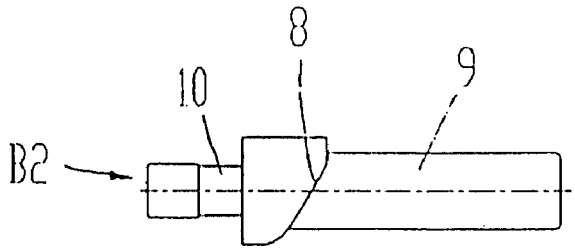
Figure 7:
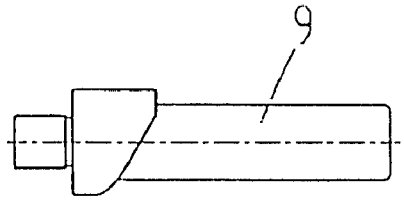

FIGS. 6-7 show a line shock absorber B2 comprising a housing 9, a ring coulisse 8 integrated into the housing 9, as well as an extended (FIG. 6) and encased (FIG. 7), respectively, a piston rod 10. When comparing the illustrations of FIGS. 6-7 it is evident that in this embodiment the stationary member of the respective assembly is the piston rod 10, while the housing 9 is axially shiftable. For forcing apart the housing 9 and the piston rod 10, a pressure spring (not shown) is installed between a front-end section of the piston rod 10 and a bottom member of the housing 9.

Figure 8:
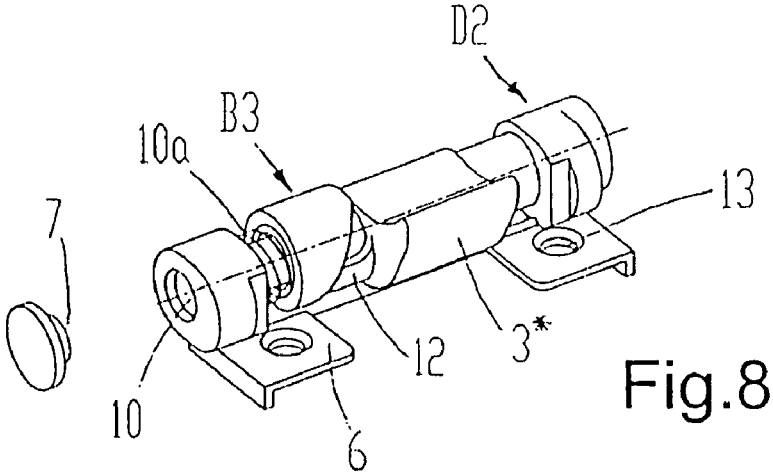
Figure 9:
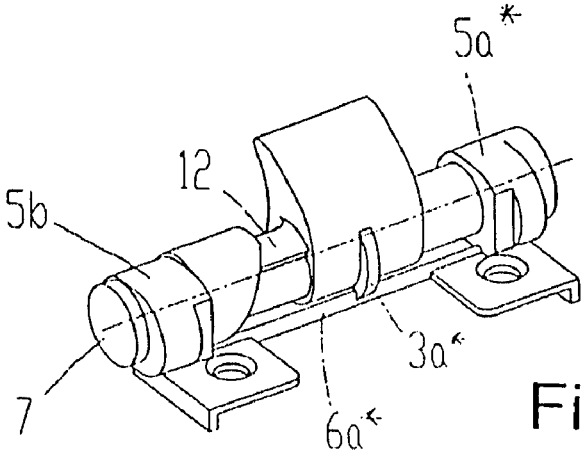

FIGS. 8-9 illustrate an assembly composed of a line shock absorber B3 (i.e. the line shock absorber B2 of FIGS. 6-7 without an inner pressure spring), a holder D2 (i.e. the holder D1 of FIG. 17 adapted to the shock absorber B3), a wing 3* (i.e. the wing 3 of FIG. 4 adapted to the line shock absorber B3), and an outer pressure spring 10*a*, with an axle support 7 for the piston rod 10 of the line shock absorber being dismounted (FIG. 8) and mounted (FIG. 9), respectively. The piston rod 10 of the shock absorber B3 is fastened in a bearing 5*b of the holder D2 and stands still, while the housing 9 of the shock absorber B3 is axially shiftably, non-rotationally, guided in a bearing 5*a of the holder D2. A pressure spring 10*a* is installed between the front end section of the housing 9 of the shock absorber B3 where the ring coulisse 8 resides, and the bearing 5*b where the piston rod 10 of the shock absorber B3 is fastened. Axially in front of the ring coulisse 8, a counter-coulisse 12 is formed integrally with the wing 3*, the counter-coulisse 12 permanently engaging the coulisse 8. The engagement of the coulisse 8 and the counter-coulisse 12 is not self-locking and, hence, no special spring is required for returning the wing 3* into the starting position. The wing 3* is freely put on the housing 9 of the shock absorber B3. In the present specific embodiment where the axial extension of the wing 3* does not extend to the bearing 5***a*, the wing 3* is permanently retained in its axial position by an arcuate rib 3*a*, which is formed integrally with the rear side of the wing 3*(FIG. 9) and which engages a respective slot (not shown) provided in a spacer piece 6*a* of the holder D2.

Figure 10:
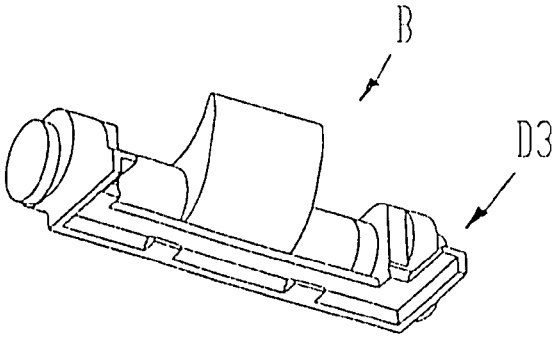

FIG. 10 shows an assembly composed of the shock absorber B (either of the rotary type or of the line type) and a holder D3 belonging to it, the holder being modified to be combined with a hinge pot L1 adapted to it by means of a snap connection by the holder D3 snapping the hinge pot L1 from below, and FIGS. 11 and 18 to 20 illustrate a device composed of the assembly of FIG. 10 and the hinge pot L1. To this end, one or more, in this specific case two, saddle-shaped recesses 21 are foreseen along a distal transversal edge of a fastening flange of the hinge pot L1, while two prongs 20 for engaging from below are formed integrally with the spacer piece 6*a* of holder D3, said prongs being provided with respective indentations 21 for engaging the recesses 22.

Figure 11:
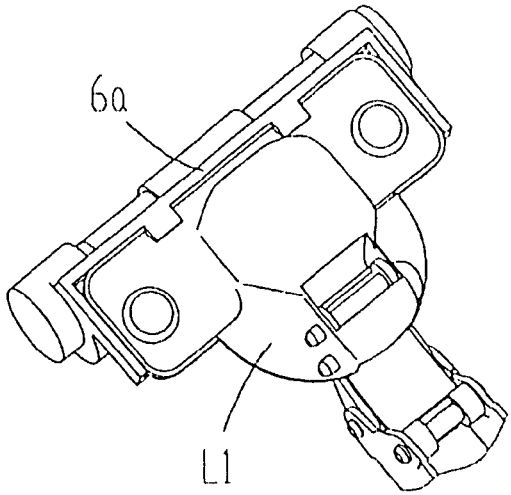
Figure 18:
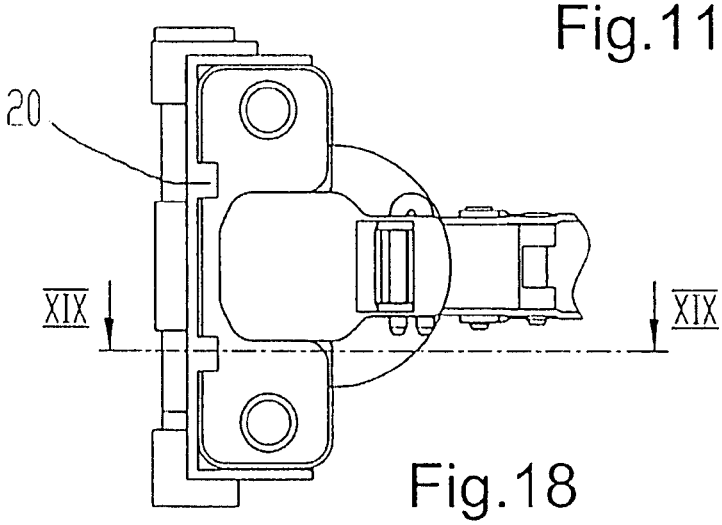
Figure 20:
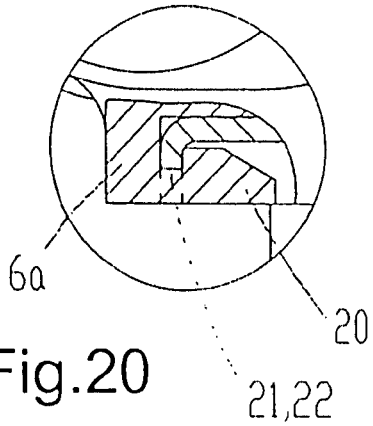
Figure 19:
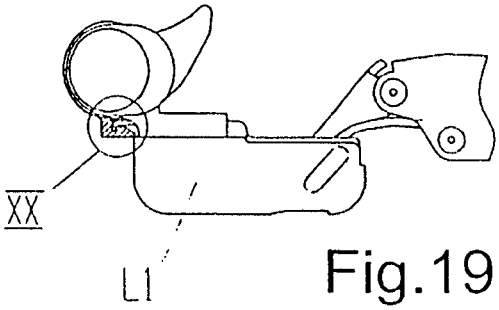
Figure 12:
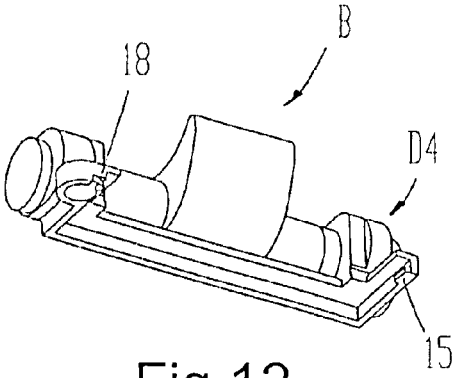
Figure 13:
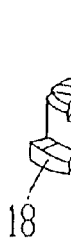
Figure 16:
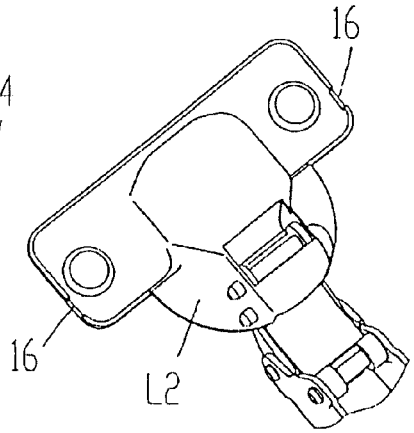
Figure 14:
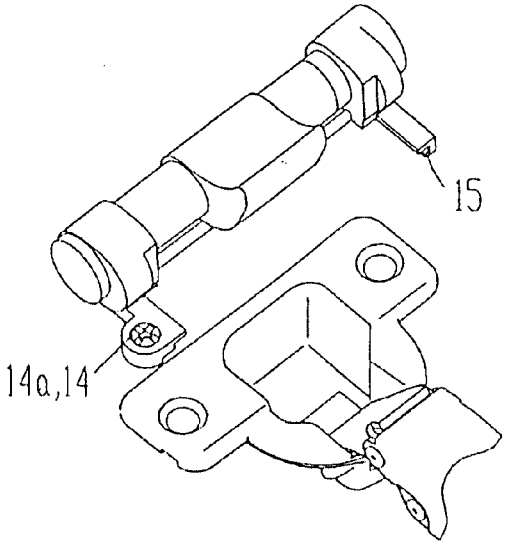
Figure 15:
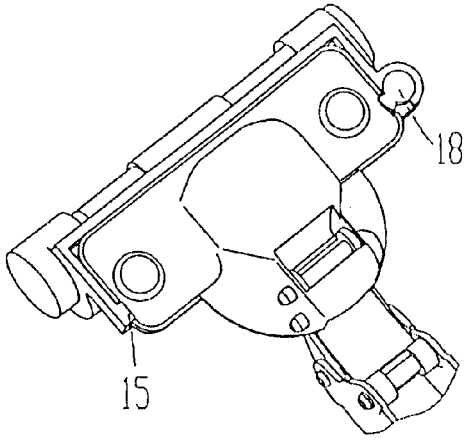

The illustration FIG. 12 is analogous to FIG. 10 and the illustration FIG. 15 is analogous to FIG. 11 with a different embodiment of the holder D4 and a hinge pot L2 adapted to it. To this end, a saddle-shaped recess 16 is foreseen with either longitudinally extending reinforcing projection of a fastening flange of the hinge pot L2. The holder D4 provides a prong 15 for engaging one of said recesses from below, while a drum-shaped appendix 14*a* is integrally added to the holder D4 for operating another one of the two said recesses 16, said appendix 14*a* retaining a plug 14, which provides, formed integrally with it, a latch member 18 for engaging said another saddle-shaped recess 16. Usually, rotary latch members are designed to have a supporting inclination, and, preferably, so is the latch member 18 (FIG. 13).

Figure 21:
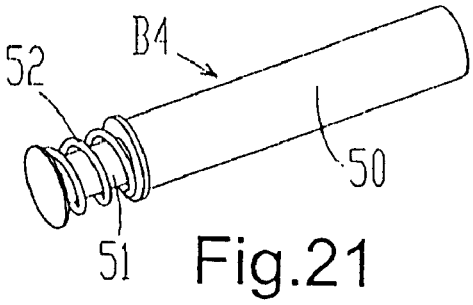
Figure 22:
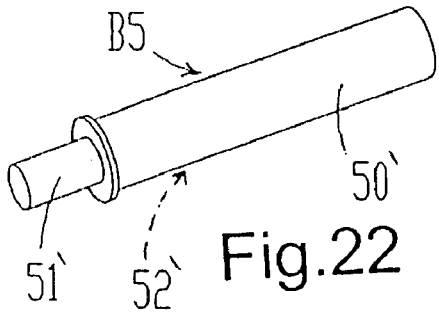
Figure 23:
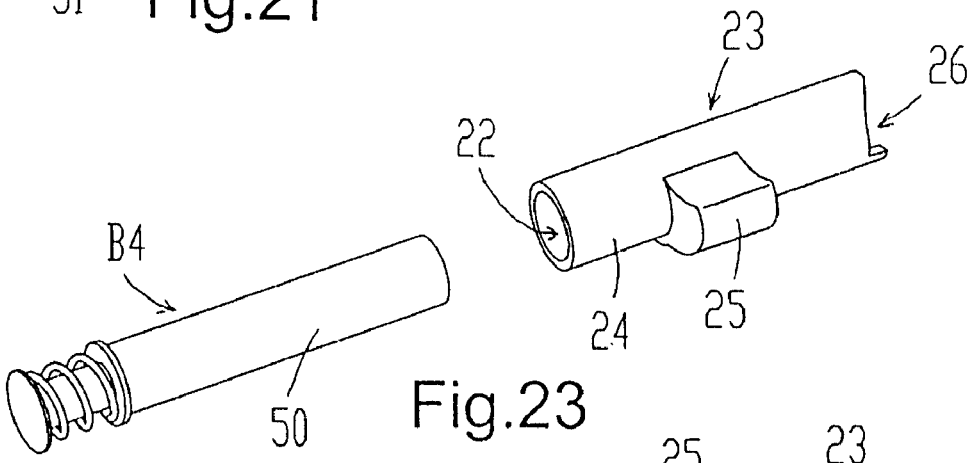
Figure 24:
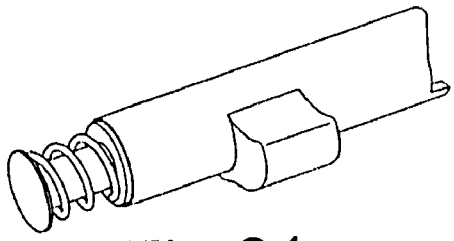
Figure 25:
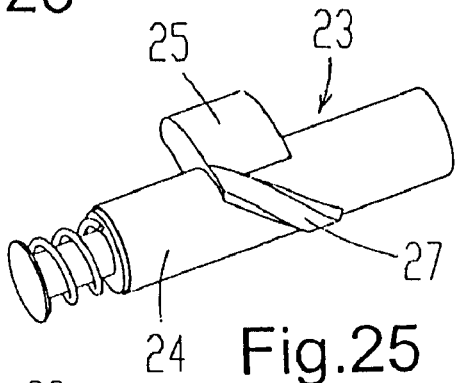

A line shock absorber B4 (FIG. 21) comprises a housing 50, a piston rod 51, and an outer pressure spring 52, while an alternative shock absorber B5 (FIG. 22) comprises a housing 50', a piston rod 51', and an inner pressure spring 52'. A bearing 22 of a wing sleeve 23 (FIG. 23) is fitted into the mantle configuration of the housing 50, 50' of the shock absorber. Said wing sleeve 23 is a complex constructional member with a sleeve 24 and a wing 25 representing the main constructional components thereof. Both ends of said sleeve 24 are plainly cut to size with a wedged recess 26 provided frontally at the end of sleeve 24 not reached by the shock absorber B4, B5. In the present embodiment, the wing 25 is an element which co-operates, when absorbing a shock of a door wing at closing a furniture unit, with the back surface of a hinge arm H of the toggle-type hinge; therefore the extension of the wing 25 measured along the axis of the sleeve corresponds to the width of said back surface. In the axial direction of the sleeve, the wing 25 is arranged practically in the middle thereof. The wing 25 provides a striking rolling side 25' (to co-operate with the back mantle surface of the hinge arm) and a back side 25". To a base portion of said striking rolling side 25' of the wing 25, one end of a special spiral rib 27 is connected or resides there, said rib 27 being placed on the mantle surface of the sleeve 24. Said rib provides a relatively steep right spiral with an inclination of a magnitude of 45° only encompassing the mantle surface of the sleeve 24 on an extension of a magnitude 90°.

For practical manufacturing reasons, the shock absorber B4, B5 is an elementary member with respect to the wing sleeve 23. In a special embodiment, the housing 50, 50' of the shock absorber B4, B5 and the wing sleeve 23 can be united to form a unique member.

Figure 26:
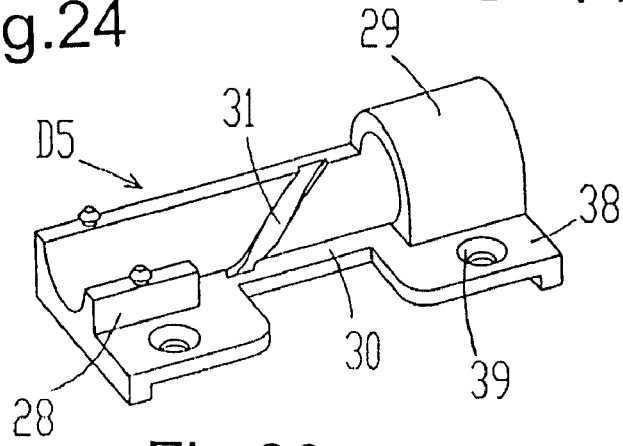
Figure 27:
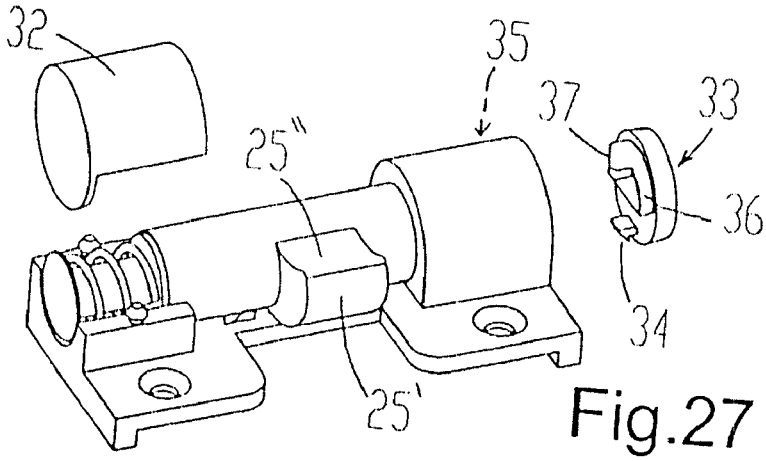
Figure 28:
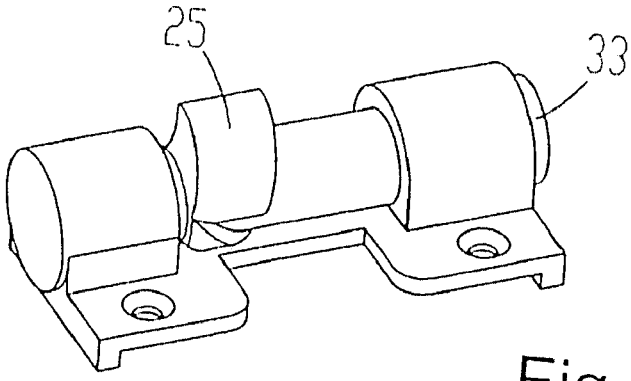
Figure 29:
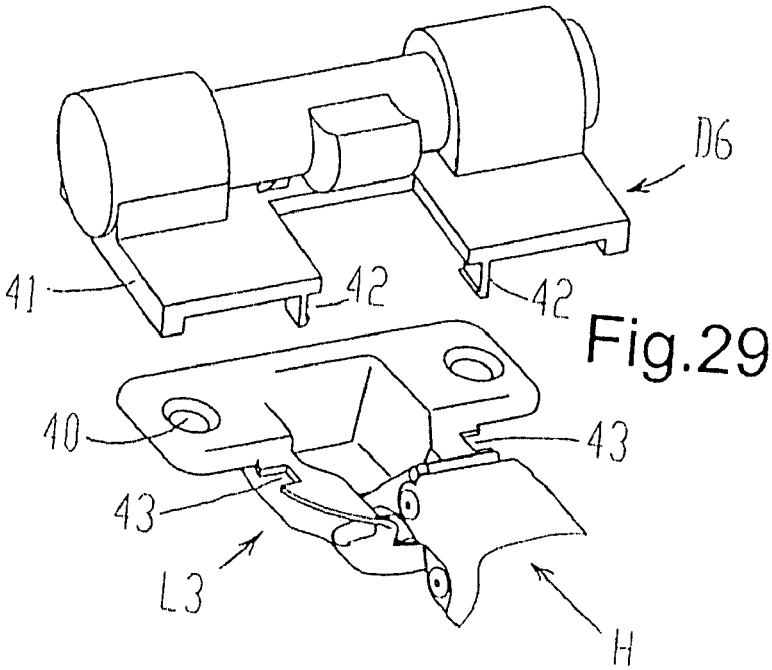
Figure 30:
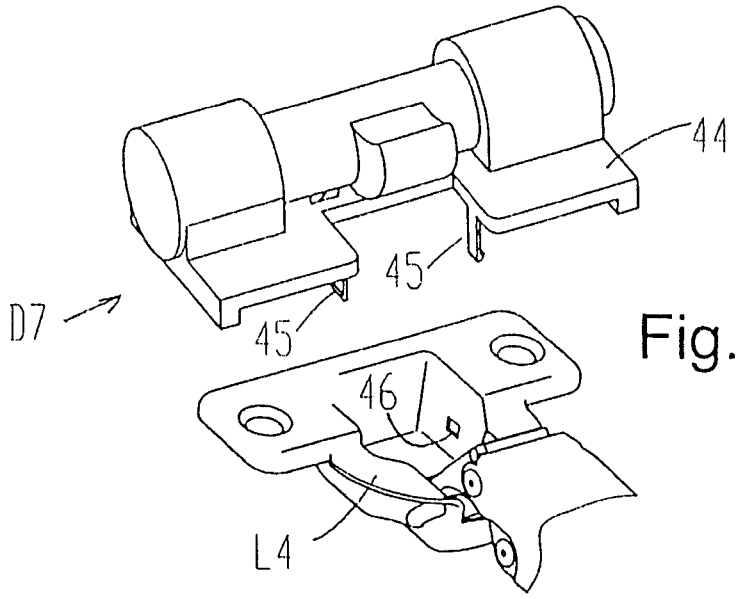

An assembly composed of the shock absorber B4, B5 and the wing sleeve 23 is inserted into a holder D5 (FIGS. 26-28), D6 (FIG. 29), D7 (FIG. 30) of the shock absorber. The section of the holder D5, D6, D7 provided to receive said assembly is practically the same with all embodiments, the holders D5; D6, D7 differ from each other in the construction of the section for the fastening thereof to a hinge pot L3, L4 of the toggle-type hinge.

The section of holder D5, D6, D7 to accommodate the assembly of the shock absorber B4, B5 and the wing sleeve 23 is composed of a semi-bearing 28, a bearing 29 and a spacer piece 30 with said members all fitted into the mantle diameter of the wing sleeve 23. In the present specific embodiment, said spacer piece 30 practically provides for a 120° bearing for said wing sleeve 23 with a first edge of said bearing residing at a base portion of the holder and a second edge thereof residing in the horizontal diametral level of the semi-bearing 28. In the said practically 120° bearing a spiral groove 31 is foreseen to accommodate and guide said spiral rib 27.

Due to such a construction the pair of elements constituted by the rib 27 and the groove 31 is not self-locking.

Instead of the pair of elements composed of the rib 27 and the groove 31 with the possibility of said elements in pair being reversed, there are also possible further motion-locking interconnections of the wing sleeve 23 and the holder D5, D6, D7, such as e.g. a combination of a groove and a point glide as well as a combination of a groove against groove with a ball placed inbetween etc.

For the assembly of the shock absorber B4, B5 and the wing sleeve 23 being retained in the holder D5 (FIG. 27), a semi-bearing 32 having two functions, namely to be a thrust bearing and a cap, is provided at one end of said assembly, while an axial control support 33 is provided at the other end of said assembly. Said semi-bearing 32 covers both the free section of a piston rod 51, 51' and the end section of the sleeve 24 residing there, and axially supports the piston rod 51, 51' when spirally moving the wing sleeve 23 from the bearing 29 against the bearing 28, 32. Said axial control support 33 is a plug closing the free side of the bearing 29 and axially supporting the free end of the sleeve 24 when in the course of the operation of the present device the wing sleeve 23 is spirally shifted from the bearing 28, 32 against the bearing 29.

In the present embodiment, the interconnection of the axial control support 33 and of the bearing 29 is composed on the one hand on a tooth 34 engaging an annular groove 35 (not shown) in the bearing surface of the bearing 29 and on the other hand on a cylindrical segment 36 added to the axial control support 33 and sufficiently tightly engaging the same bearing surface. A tooth 37 fitted into the wedged recess 26 of the sleeve 24 and engaging it is arranged with the segment 36.

In a zero starting state of the device (FIG. 27), the lower edge of the spacer piece 30 of the holder D5, D6, D7 supports the striking rolling side 25' of the wing 25. A turning movement of the tooth 37, whose inclined edge engages an inclined edge of the wedged recess 26, results in an axial movement of the wing sleeve 23. Since in the course of the said action the latter spirally rotates (due to the rib 27 engaging the groove 31), this results in a circumferential removal of the wing 25 from the spacer piece 30 and, hence, in the beginning of a delayed shock-absorbing function. Naturally, by a suitable sizing of the elements it is provided that the axial step of the wedged recess 26 does not strike against the axial step of the tooth 37.

A translatory movement of the wing 25 results in a sliding thereof transversely across the back surface of the hinge arm, whereat the wing 25 does not slide off the hinge arm.

In a special embodiment (not shown), the pair of members composed of the spiral rib 27 and the spiral groove 31 is arranged within the bearing 29.

The section of holder D5 (FIGS. 26-28) prepared to be fastened to a hinge pot (including L3, L4) of the toggle-type hinge provides an apertured (apertures 39) flange 38, the apertures 39 coinciding with apertures 40 provided in a flange of said hinge pot for screws (not shown).

In a modified embodiment (not shown), the semi-bearings 28, 32 are united to form a unique bearing fastened to the flange 38. In this specific case, the pair of components composed of the spiral rib 27 and the spiral groove 31 can be arranged in the zone of said bearing.

The section of the holder D6 (FIG. 29) prepared to be fastened to the hinge pot L3 of the toggle-type hinge provides a flange 41 having snap projections 42 to engage recesses 43 provided in a flange of the hinge pot L3, said recesses 43 arranged outside within a zone of a cavity (not shown) made to incorporate said hinge pot L3 in a furniture panel (not shown).

The section of the holder D7 (FIG. 30) prepared to be fastened to the hinge pot L4 of the toggle-type hinge provides a flange 44 having snap projections 45 to engage openings 46 provided in a wall portion of a cavity of said hinge pot L4 in a direction from inside to outside.

Figure 31:
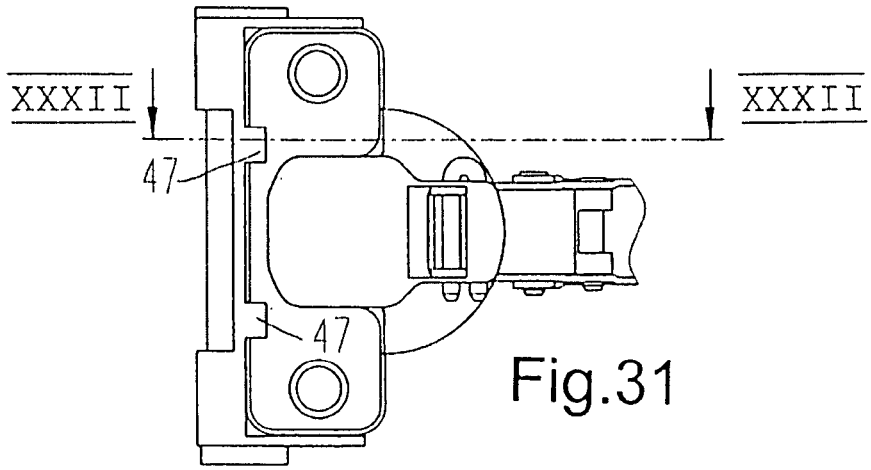
Figure 33:
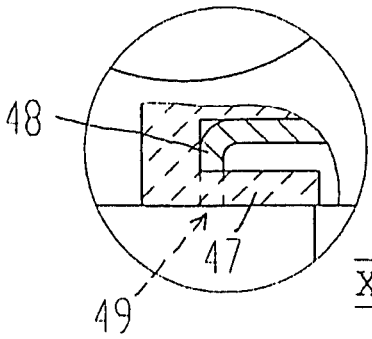
Figure 32:
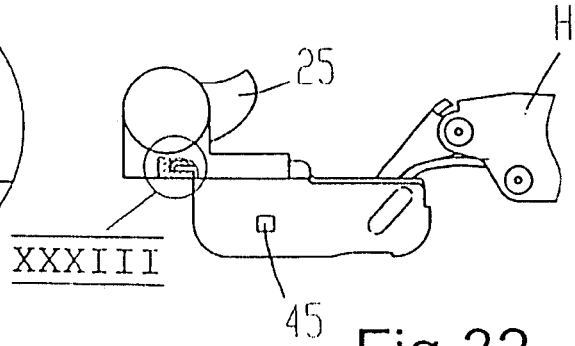

In addition to said snap connection composed of snap projections 45 and openings 46, the holder D7 is connected to the hinge pot L4 by a form-lock. To this end, two prongs 47 (FIGS. 31-33) for engaging from below are foreseen with the spacer piece 30, and bearings 49 are foreseen in a reinforcing rim 48 of the hinge pot L4 to receive them.

The invention claimed is:

1. A furniture hinge with equipment comprising a toggle-type hinge and a rotary shock absorber, the toggle-type hinge having a hinge arm with a longitudinal axis being supported by a furniture side panel and a hinge pot supported by a furniture wing, the toggle-type hinge connecting the furniture side panel and the furniture wing to swing relative to each other and providing pivoting of the furniture wing around a pivoting axis, the rotary shock absorber being mounted onto the hinge pot by a holder and engaging the hinge arm to absorb shocks of the toggle-type hinge and the furniture wing respectively when the furniture wing is moved towards the furniture side panel, said rotary shock absorber being a line shock absorber composed of a housing, a piston rod, a pressure spring and a wing sleeve arranged transversely to a longitudinal axis of the toggle-type hinge so that the longitudinal axis of the toggle-type hinge is coincident with a longitudinal axis of the hinge arm, and perpendicular to the pivoting axis of the furniture wing, the wing sleeve including a sleeve and a wing, and the wing sleeve co-operating, when absorbing a shock of the furniture wine at closing a furniture unit, with a back surface of the hinge arm of the toggle-type hinge.

2. The furniture hinge with equipment according to claim 1, wherein the pressure spring of the shock absorber is an outer pressure spring placed at a free end of the piston rod.

3. The furniture hinge with equipment according to claim 2, wherein the shock absorber is inserted into the wing sleeve to form an assembly being retained in the holder to fix the shock absorber onto the hinge pot, the shock absorber has a mantle configuration with a bearing of the wing sleeve.

4. The furniture hinge with equipment according to claim 3, wherein the shock absorber and the wing sleeve are inserted into the holder of the shock absorber, and the holder is fastened to the hinge pot.

5. The furniture hinge with equipment according to claim 4, wherein the holder has a section to accommodate assembly of the shock absorber and the wing sleeve, the section includes a semi-bearing, a bearing and a spacer piece in between.

6. The furniture hinge with equipment according to claim 5, wherein said spacer piece forms substantially a 120° bearing for said wing sleeve with a first edge of said bearing located at a base portion of the holder and a second edge thereof located in a horizontal diametral level of the semi-bearing.

7. The furniture hinge with equipment according to claim 6, wherein in the substantially 120° bearing a spiral groove of the holder accommodates and guides a spiral rib of the shock absorber.

8. The furniture hinge with equipment according to claim 7, wherein the semi bearing includes a thrust bearing and a cap provided at one end of the holder of the shock absorber, while an axial control support is provided at the other end of said holder.

9. The furniture hinge with equipment according to claim 5, wherein the section of the holder includes a flange having snap projections to engage recesses provided in a flange of the hinge pot.

10. The furniture hinge with equipment according to claim 5, wherein a section of the holder includes a flange having snap projections to engage openings provided in a wall portion of a cavity of said hinge pot in a direction from inside to outside.

11. The furniture hinge with equipment according to claim 5, wherein two prongs of the spacer piece engage a reinforcing rim of the hinge pot.

12. The furniture hinge with equipment according to claim 1, wherein the pressure spring of the shock absorber is an inner pressure spring arranged inside the housing.

13. The furniture hinge with equipment according to claim 12, wherein the shock absorber is inserted into the wing sleeve to form an assembly being retained in the holder to fix the shock absorber onto the hinge pot, the shock absorber has a mantle configuration with a bearing of the wing sleeve.

14. The furniture hinge with equipment according to claim 1, wherein the sleeve includes a wedged recess provided frontally at one end of the sleeve.

15. The furniture hinge with equipment according to claim 14, wherein the wing sleeve includes a back side and a base portion of a striking rolling side to cooperate with a back mantle surface of the hinge arm of the toggle-type hinge to absorb a shock of the furniture wing at closing of the furniture unit, and to which one end of a special spiral rib is connected or resides, said rib is placed on the mantle surface of the sleeve.

* * * * *